United States Patent [19]

Watanabe et al.

[11] 4,254,787

[45] Mar. 10, 1981

[54] COIN ACCUMULATION CYLINDER CHANGEOVER ALARM

[75] Inventors: Kenkichi Watanabe; Katusuke Furuya, both of Tokyo, Japan

[73] Assignee: Laurel Bank Machine Co., Ltd., Tokyo, Japan

[21] Appl. No.: 66,324

[22] Filed: Aug. 14, 1979

[30] Foreign Application Priority Data

Aug. 15, 1978 [JP] Japan ..... 53-111709[U]

[51] Int. Cl.[3] ..... G07D 9/06

[52] U.S. Cl. ..... 133/8 A; 53/77; 53/212; 53/508; 133/1 A; 141/155

[58] Field of Search ..... 133/1 R, 1 A, 8 A; 53/77, 507, 508, 532, 212; 141/94, 192, 155, 159; 221/2

[56] References Cited

U.S. PATENT DOCUMENTS

| | | | |
|---|---|---|---|
| 2,340,536 | 2/1944 | Joplin | 141/159 |
| 2,841,934 | 7/1958 | Schoenewolf | 53/77 X |
| 3,373,542 | 3/1968 | Ikeuchi | 53/532 |
| 3,432,983 | 3/1969 | Picollo | 53/212 X |
| 3,938,303 | 2/1976 | Ushio et al. | 53/212 |

FOREIGN PATENT DOCUMENTS

| | | | |
|---|---|---|---|
| 2756273 | 6/1978 | Fed. Rep. of Germany | 133/8 A |
| 2805978 | 8/1979 | Fed. Rep. of Germany | 133/8 A |
| 53-55367 | 5/1978 | Japan . | |

*Primary Examiner*—Robert J. Spar
*Assistant Examiner*—Edward M. Wacyra
*Attorney, Agent, or Firm*—Fleit & Jacobson

[57] ABSTRACT

There is provided a coin packaging machine which comprises a coin denomination selection handle provided with a rotary operation plate. A coin denomination side switch is opened or closed by the operation plate. A coin accumulation side switch is opened or closed by mounting or dismounting an accumulation cylinder. A changeover switch is provided and an electric circuit including the coin denomination switch, the coin accumulation side switch and the changeover switch is constructed so that the machine cannot be started unless accumulation cylinders are dismounted and then re-mounted.

2 Claims, 2 Drawing Figures

COIN ACCUMULATION CYLINDER CHANGEOVER ALARM

BACKGROUND OF THE INVENTION

1. Field of the Invention

The present invention relates to a coin packaging machine. More particularly, the invention provides a coin packaging machine which cannot be started unless accumulation cylinders are exchanged thus positively preventing such hindrances as forgetting to exchange or mount an accumulation cylinder.

2. Description of the Prior Art

In coin packaging machines now being marketed, accumulation cylinders are exchanged according to the denominations of coins to be packaged. This exchange is performed in order to smoothly perform the packaging of coins arranged and stacked horizontally in an accumulation cylinder. Therefore, there should be prepared a number of accumulation cylinders having inner diameters suited to the outer diameters of different denominations of coins to be packaged. However, the exchange of an accumulation cylinder having an inner diameter suited to coins to be packaged is left entirely up to the user. Accordingly, the user often forgets to mount an accumulation cylinder or exchange an accumulation cylinder installed for a previous denomination. If the machine is started in this state, coins are not completely packaged or are scattered in the machine, or may jam the counting passage to cause troubles or disorders in a feed mechanism or counting mechanism.

SUMMARY OF THE INVENTION

It is a primary object of the present invention to provide a coin packaging machine in which the foregoing disadvantages, especially forgetting to mount accumulation cylinders, are eliminated.

In accordance with the present invention, there is provided a coin packaging machine which comprises a coin denomination selection handle, a rotary operation plate disposed co-operatively with the coin denomination selection handle, a coin denomination selection side switch to be opened or closed by said operation plate and a coin accumulation side switch to be opened or closed by mounting or dismounting an accumulation cylinder, and a changeover switch which is changed over to the side of an alarm circuit when the coin denomination selection handle is operated and which is changed over to the side of a starting circuit when one accumulation cylinder is dismounted, said starting circuit being adapted to energize a coin packaging machine starting relay when the other accumulation cylinder is mounted whereby the machine cannot be started unless accumulation cylinders are dismounted and then re-mounted.

BRIEF DESCRIPTION OF THE DRAWINGS

Other objects and advantages of the present invention will become apparent from the following description made with reference to the accompanying drawings, in which.

DETAILED DESCRIPTION OF THE PREFERRED EMBODIMENT

Figure 1:
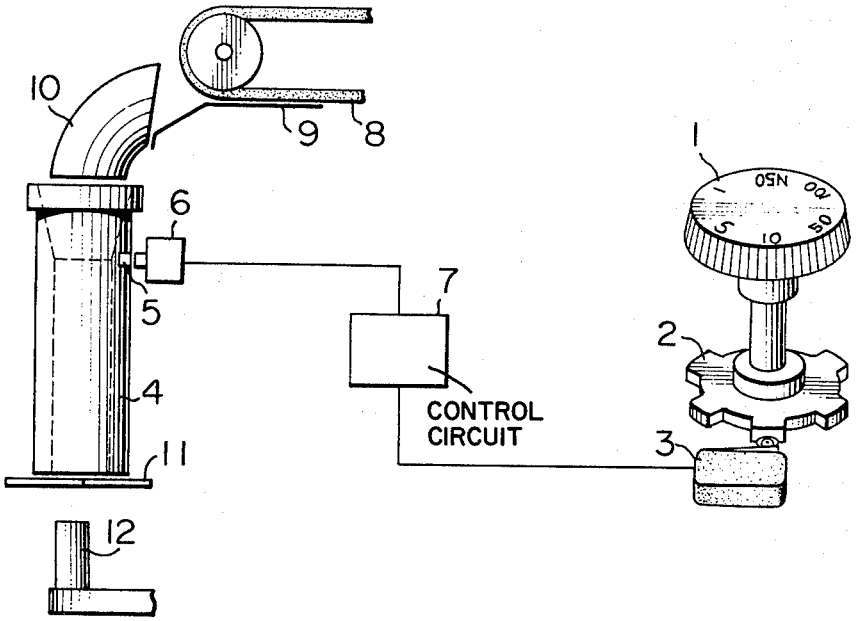
FIG. 1 is a front view illustrating diagrammatically the main portion of one embodiment of the coin packaging machine according to the present invention.

The present invention will now be described with reference to an embodiment shown in the accompanying drawings.

A cam shaped operation plate 2 is disposed cooperatively with a coin denomination selection handle 1 that is operated in conformance with the coin denomination to be packaged, and provided is a coin denomination selection side switch 3 operable in response to the operation plate 2.

A dismountable accumulation cylinder 4 has an operation member 5 such as a magnet or projection, and provided is an accumulation cylinder side switch 6 such as a reed switch or micro-switch that is operated in accordance with the operation member 5. The coin denomination selection side switch 3 is connected to the accumulation cylinder side switch 6 through a control circuit 7.

Reference numeral 8 represents a feed belt which is arranged to feed coins (not shown) on a coin counting passage 9 into the accumulation cylinder 4 through a chute 10. On the lower end of the accumulation cylinder 4, there are disposed a shutter 11 which is opened when a predetermined number of coins are accumulated in the cylinder and a coin receiving rod 12 for supporting accumulated coins and feeding them to the packaging zone (not shown).

Figure 2:
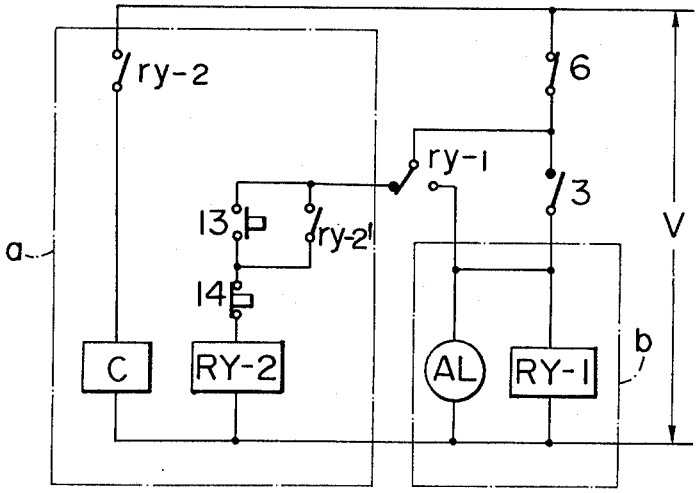
FIG. 2 is an electric wiring diagram.

An electric circuit including both the switches 3 and 6 and the control circuit 7 is illustrated in the electric wiring diagram of FIG. 2. This circuit includes a starting circuit a and an alarm circuit b, which will be described in detail in the description of the operation given hereinafter. Power is supplied to the starting circuit a or the alarm circuit b through a change-over switch ry-1 of a relay RY-1.

When coins of the denomination suitable for the accumulation cylinder 4 are packaged by using the accumulation cylinder 4 and it is then desired to package coins of another denomination, the coin denomination selection handle 1 is rotated and is set at the graduation of the desired denomination. The operation plate 2 rotates with rotation of the coin denomination selection handle 1 to open and close the coin denomination selection side switch 3. More specifically, the coin denomination selection side switch 3 which has been opened as shown in FIG. 1 is closed once by the operation plate 2 and it is then opened again when the coin denomination is selected. If the coin denomination selection side switch 3 is closed in FIG. 2, the relay RY-1 is actuated to switch the change-over switch ry-1 to allow an electric current to flow in the alarm circuit b, this being possible since the accumulation side switch 6 remains closed (the accumulation cylinder 4 is still mounted and has not yet been exchanged). Simultaneously, an alarm member AL such as a lamp or alarm is actuated to indicate that exchange of the accumulation cylinder 4 has not yet been effected. Even if the once closed coin denomination selection side switch 3 is opened again, the alarm is maintained by the relay RY-1 which has been self-held through the change-over switch ry-1.

When the accumulation cylinder 4 is dismounted, the accumulation cylinder side switch 6 is opened to cut off the electric current flowing to the alarm circuit b. On de-energization of the relay RY-1, the change-over switch ry-1 is changed over to the side of the starting circuit a. Since the electric current is interrupted during the absence of a mounted accumulation cylinder 4, the machine will not start, hereinafter described in detail, even if a start button 13 is depressed. Erroneous operation is thus prevented.

When the accumulation cylinder 4 is dismounted and exchanged for another accumulation cylinder 4, the operation member 5 on the other cylinder actuates the accumulation cylinder side switch 6 which is thus closed. Accordingly, if the start button 13 is depressed, an electric current is applied to a relay RY-2 to close a release switch ry-2 of the relay RY-2, thereby to start a packaging machine starting relay c. The contact ry-2' of the relay RY-2 is for a self-holding purpose. Reference numeral 14 represents a stop button.

In the foregoing embodiment, only exchange of accumulation cylinders is performed. There may be adopted a modification in which the position of the operation member 5 is changed according to the coin denomination, and accumulation cylinder side switches 6 are mounted at points corresponding to the respective positions of the operation member 5. In such a modification, the machine would start only when an accumulation cylinder suitable for the selected coin denomination is mounted, thus allowing erroneous operation to be effectively prevented (see Japanese Utility Model Laid-Open Publication No. 55367/78).

As will be apparent from the foregoing illustration, according to the present invention, since the machine cannot be started unless accumulation cylinders are exchanged, forgetting to dismount or exchange accumulation cylinders can be prevented.

What is claimed is:

1. A coin packaging machine which comprises a coin denomination selection handle, a rotary operation plate disposed co-operatively with the coin denomination selection handle, a coin denomination selection side switch to be opened or closed by said operation plate and a coin accumulation side switch to be opened or closed by mounting or dismounting an accumulation cylinder, and a changeover switch which is changed over to the side of an alarm circuit when the coin denomination selection handle is operated and which is changed over to the side of a starting circuit when one accumulation cylinder is dismounted, said starting circuit being adapted to energize a coin packaging machine starting relay when another accumulation cylinder is mounted whereby the machine cannot be started unless accumulation cylinders are dismounted and then re-mounted after an operation of the coin denomination handle.

2. A machine as set forth in claim 1 wherein said alarm circuit includes an alarm for letting an operator know the necessity of exchangement of accumulation cylinders.

* * * * *